United States Patent [19]

Kreyenbuhl

[11] 4,108,467

[45] Aug. 22, 1978

[54] SKI BINDING

[75] Inventor: Armand Kreyenbuhl, Samoens, France

[73] Assignee: Adidas Fabrique de Chaussures de Sport, Landersheim, France

[21] Appl. No.: 666,589

[22] Filed: Mar. 15, 1976

[30] Foreign Application Priority Data

Mar. 17, 1975 [FR] France ..... 75 08182
Apr. 9, 1975 [CH] Switzerland ..... 4490/75

[51] Int. Cl.[2] ..... A63C 9/18
[52] U.S. Cl. ..... 280/615; 36/117
[58] Field of Search ..... 280/615, 614, 611, 623; 36/125, 122, 117, 121, 120

[56] References Cited

U.S. PATENT DOCUMENTS

| | | | |
|---|---|---|---|
| 2,246,152 | 6/1941 | Wallace | 280/614 |
| 3,219,359 | 11/1965 | Schneider | 280/633 |
| 3,363,342 | 1/1968 | Stohr | 36/117 |
| 3,603,606 | 9/1971 | Eie | 280/615 |
| 3,621,591 | 11/1971 | Hanson et al. | 36/117 |
| 3,899,186 | 8/1975 | Matsuda | 280/607 |

FOREIGN PATENT DOCUMENTS

| | | | |
|---|---|---|---|
| 1,082,112 | 6/1954 | France | 280/610 |
| 83,367 | 5/1935 | Sweden | 280/615 |
| 89,860 | 7/1937 | Sweden | 280/615 |

*Primary Examiner*—Joseph F. Peters, Jr.
*Assistant Examiner*—Milton L. Smith
*Attorney, Agent, or Firm*—Brisebois & Kruger

[57] ABSTRACT

Ski binding for cross-country skis comprises an archplate attached to the ski which receives an extension from the front of the sole of the foot, and a pin passing through the archplate and extension to fasten them together.

18 Claims, 9 Drawing Figures

SKI BINDING

This invention relates to a ski binding for cross-country or tour skis.

The bindings heretofore used for tour skis consist of a foot plate the edges of which are bent vertically to form two converging arms and to which a sole gripping means is pivotally attached. This gripping means bears on an extension of the sole when it is turned down toward the front and latched by means of a hook which is turned down toward the rear. Such bindings are relatively heavy and require the use of two hands, both to put on and take off the ski. Moreover, a relatively high pressure is necessary to hold the boot in place, especially if the foot plate is not provided with projections which engage in the sole of the boot. Moreover, these arms constitute the sole means for laterally guiding the boot and contact a portion of the sole which moves up and down with the boot. This results in friction which is greater when more exact lateral control is attempted. It has been suggested that this type of binding be improved by utilizing a spring hook permitting automatic hooking so as to require only one hand, but this solution has all the other disadvantages hereinbefore mentioned, including the necessity of using both hands to take the ski off.

In addition to the difficulties inherent in the use of the known bindings, these bindings also have the disadvantage of being heavy and bulky and permitting substantial pivoting of the boot which does not remain constantly in alignment with the axis of the ski. This is a serious disadvantage for the skier.

This invention is designed to reduce the aforesaid disadvantages and to provide a ski binding which is simple in construction, takes up little space, and is light in weight, and which ensures perfect retention of the boot in alignment with the axis of the ski, while permitting the skier to lift his heel easily, as is essential to his progress.

It is an object of the invention to provide a ski binding especially for a cross-country or tour ski of the type in which the boot is held in place by an extension of its sole at the front of the boot, characterized by the fact that the extension, which is integral with the sole, is engaged beneath an arch plate fixed to the ski, which plate delimits a space the section of which corresponds in width and height to that of the extension of the sole. The boot is attached to the ski by a latch member which immobilizes the extension of the sole in the archplate.

According to a preferred embodiment, the archplate has the shape of a parallelopiped open at its two ends. The front extension of the boot has a constant rectangular section, the dimensions of which correspond to those of the interior of the archplate.

In an alternative embodiment the extension of the sole may have a trapezoidal cross-section which fits into a correspondingly shaped archplate, this embodiment being preferably utilized in conjunction with a latch member which exerts a forwardly directed axial traction on the extension of the sole, for example, by means of a swinging lever actuating a spring.

The upper part of the archplate may be continuous, which makes it possible to impart greater strength to the archplate, but it may also be discontinuous, so that the upper part of the arch consists of two arms folded toward each other from the opposite ends of the vertical part of the archplate.

In a preferred embodiment the archplate carries two diverging arms lying in vertical planes and extending in the direction of the boot, so that the ends of the arms which are remote from the archplate are further apart than the opening of the archplate is wide. These arms advantageously serve to guide the right and left front parts of the boot. They make it possible to contribute to holding the boot in alignment with the axis of the ski and facilitate the introduction of the extension of the sole into the archplate.

The latching member may consist of a rod fixed to the archplate which is capable of vertically engaging and opening in the extension of the sole. This rod may be, for example, mounted on a screw or subjected to the action of a spring tending to urge it toward the position in which it is engaged in the opening in the extension of the sole.

In another preferred embodiment of the invention the latching member consists of a horizontal pin which traverses the vertical parts of the archplate and the width of the extension of the sole. This pin may be round or flattened in section. It may have the shape of a doubled pin the upper part of which returns to hook over the straight part passing through the sole. The pin may also be held in place by a small leather thong provided with a slot which engages a projection positioned above the archplate.

To avoid wear or deformation of the hole in the extension of the sole it is possible to line it with a metallic protective sleeve or a sleeve of some other hard material.

In a preferred embodiment of the invention the archplate is fixed to a base plate, which may itself be attached to the ski by screwing or adhesively. This base plate may also be imbedded in the ski, and may even be incorporated into the ski beneath the lamination which constitutes the upper surface of the ski.

It is also possible to improve the aerodynamic properties of the ski and prevent snow from accumulating at the front of the sole by providing on the ski a shaped protuberance in front of the archplate.

In a preferred embodiment, the archplate is open at both its front and back so as to limit, insofar as possible, the accumulation of snow or dirt inside it, which would make it more difficult to introduce the extension of the sole, but the use of an archplate having a wall at its front, on the side remote from the extension of the sole is not beyond the scope of the invention.

Finally, it is an object of the invention to provide a ski boot which may be used with the binding which has just been described, said ski boot being characterized by the fact that it comprises a sole and an extension which are directly molded from a plastic material, the extension being connected to the sole proper by a thinner zone which permits a flexibility facilitating the lifting of the heel.

The bindings according to the invention make it possible to save more than 50% in weight as compared with the bindings heretofore known. It is especially possible to make the archplate in such a manner that its width corresponds to the width of the ski which is the order of 4 to 5 centimeters. Despite this the width of the binding of the boot is maintained satisfactorily in alignment with the axis of the ski even when the skier exerts substantial forces thereon to change the direction of his skis.

Several embodiments of the invention will now be described, purely by way of illustration and example, with reference to the accompanying drawings on which:

Figure 1:
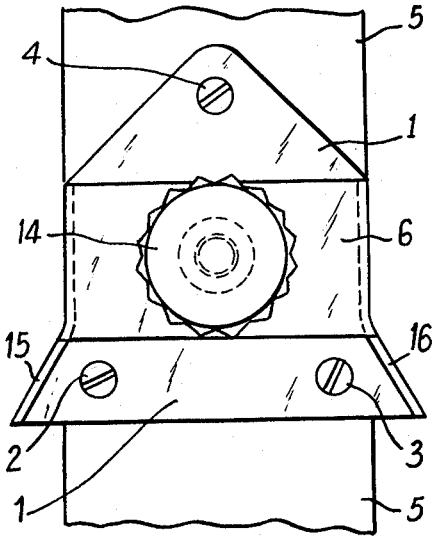
FIG. 1 is a plan view of a first embodiment of the binding according to the invention.
Figure 3:
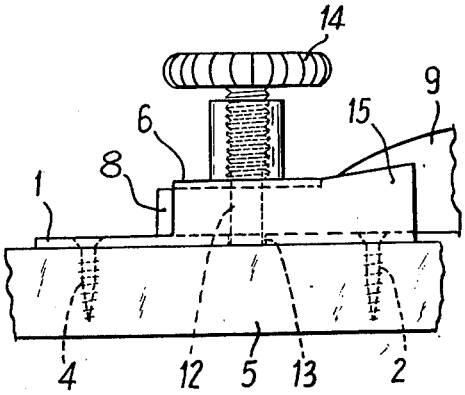
FIG. 3 is a side elevational view.
Figure 2:
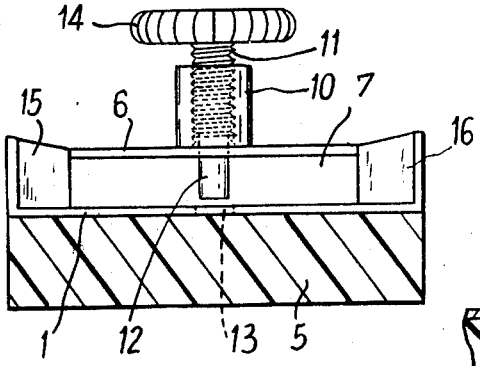
FIG. 2 is an elevational front view.

The binding shown on FIGS. 1 to 3 comprises a base plate 1 provided with three holes for attaching it by means of screws 2, 3 and 4 to a ski 5 and supporting an archplate 6 defining a space 7 having the shape of a rectangular parallelopiped and corresponding exactly to the shape of the extension 8 of the sole of the boot 9 which is to fit into the archplate 6.

The archplate 6 carries a threaded socket 10 in which is mounted a screw 11 connected to a rod 12 adapted to pass through an opening of the same diameter in the extension 8 of the sole. After having passed through the extension 8, the rod 12, in order to ensure perfect latching, seats in a hole 13 in the base plate 1. Alternatively, the open hole in the extension 8 of the sole may be replaced by a blind hole, in which case the rod 12 is subjected to greater torsion than when it is retained by both its ends.

The screw 11 is fixed to a knurled button 14 which is large enough to permit it to be rotated by hand.

In the embodiment illustrated the base plate also has at the rear of the archplate 6 two diverging arms 15 and 16, lying in vertical planes.

Instead of the button 14 it is of course possible to provide any other gripping means such as a pair of wings.

In order to permit the ski to be rapidly put on and taken off, the screw 11 may be replaced by any other means such as a bayonet device or a device comprising a spring automatically biasing the rod 12 toward the bottom. The bayonet type attaching device may be provided with a very gentle ramp and a washer of elastic material to ensure a resilient grip.

Figure 4:
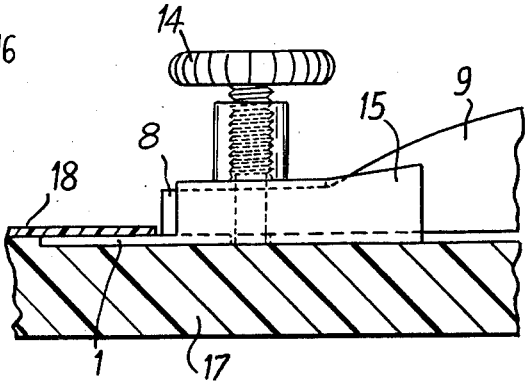
FIG. 4 shows the same binding with the archplate integrated into the ski.
Figure 5:
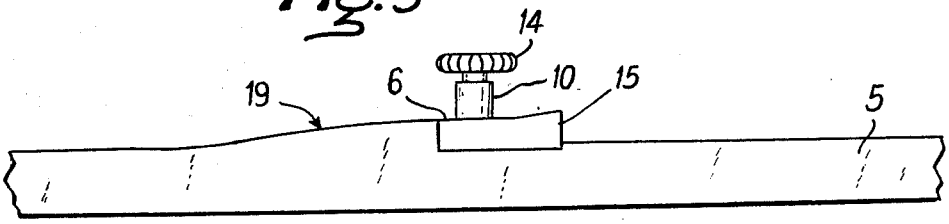
FIG. 5 shows another form of the binding of FIG. 4.

Certain materials actually used in the manufacture of cross-country skis do not hold fastening screws very well. It may therefore be judicious to integrate the binding into the ski as is illustrated in FIG. 4 on which it may be seen that the mounting plate 1 is located within the body of the ski 17 made of a synthetic high density foam material, beneath the upper lamination 18 which is made of fiberglass or some similar material. In this case the plate 1 is advantageously provided with tongues shaped and bent so as to ensure good anchorage of the binding in the body of the ski. A more complete integration of the binding into the ski is possible, as illustrated in FIG. 5. In this embodiment the ski has, in front of the binding, a shaped protuberance which merges into the front of the part 6 of the binding. This provides a sort of guide slope facilitating the gliding of the snow on the ski and prevents its accumulation in front of the binding as is the case with those bindings presently in use. Not only is the comfort improved because the accumulated snow does not penetrate into the boot, but it is easier to advance the ski in deep snow.

In its simplest form, the invention consists solely of the archplate without the base plate 1 or the arms 15 and 16.

In an alternative embodiment, the extension 8 of the sole may, instead of being parallelopipedic as hereinbefore described, have a rectangular section and a trapezoidal plan, in which case the parts 6*a* and 6*b* of the archplate 6 as seen in FIG. 1 converge forwardly, with the archplate 6 having the same shape as that of the extension of the boot.

Figure 6:
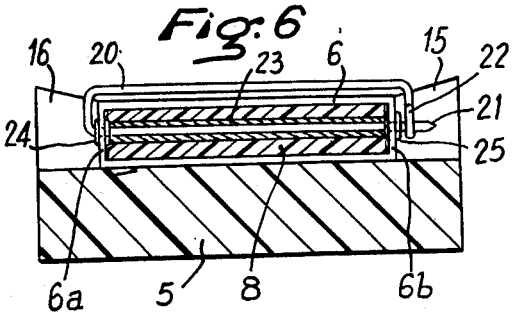
FIG. 6 is an elevational view, partially in transverse section, of another embodiment of the binding according to the invention.
Figure 7:
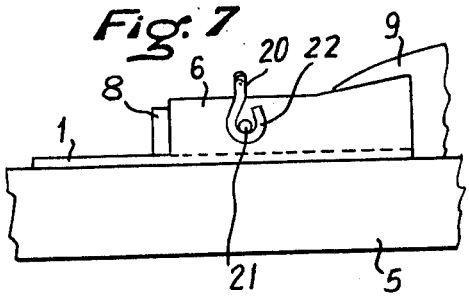
FIG. 7 is a side elevation of the device of FIG. 6.

In the embodiment illustrated on FIGS. 6 and 7 the fastener consists of a steel pin 20 passing horizontally through the vertical parts 6*a* and 6*b* of the archplate 6 as well as the extension 8 of the sole. This pin 20 has a free end 21 which fits into the curved outer end 22 of the pin. The transverse opening in the extension 8 of the sole is reinforced in the embodiment described by a sleeve 23 of metal or some other hard material. The holes in the walls 6*a* and 6*b* of the archplate may also be reinforced by metallic eyes 24 and 25.

The play between the pin and the holes is about 2/10 of a millimeter.

Figure 8:
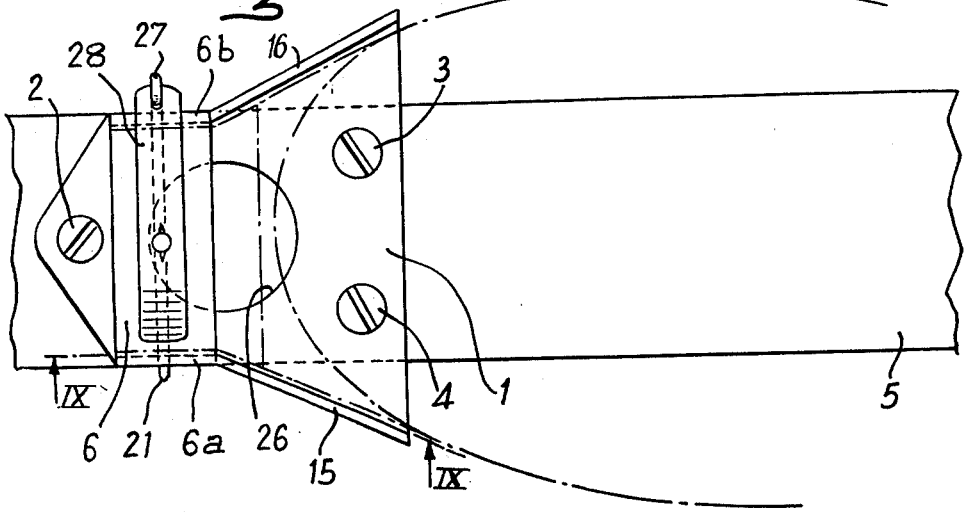
FIG. 8 is a top plan view of another embodiment of the invention.

FIG. 8 shows a plan view of another embodiment of the invention in which the plate 1 which supports the archplate 6 is also fixed to the ski by screws 2, 3 and 4. The vertical sides 6*a* and 6*b* of the archplate also carry diverging arms 15 and 16 having a substantial length which extend beyond the sides of the ski 5 to receive the end of the boot and the sole, which are illustrated in FIG. 8 in broken lines. A hole 28 is provided in the plate 1 so as to lighten it.

Figure 9:
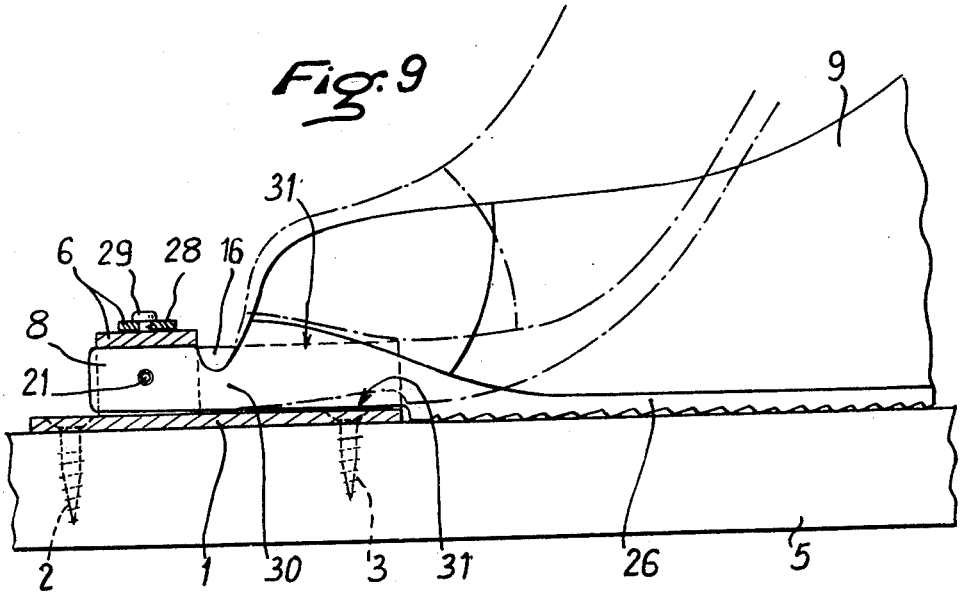
FIG. 9 is a sectional view taken along the line IX—IX of FIG. 8.

FIG. 9 also shows the ski 5, the plate 1 which supports the archplate 6 and the arms 15 and 16.

In this embodiment the extension 8 of the sole 26 is pierced by a pin 21 one end of which is bent back and provided with a ring 27, which receives a member 28 of flexible plastic material, which is provided with a slot adapted to engage over a projection 29 on the top of the archplate.

As may be seen on FIG. 9 the sole proper 26 is connected to the extension 8, which is latched in the archplate 6, by a thinner zone 30 so as to ensure a certain flexibility at the front of the boot which facilitates the lifting of the heel, as is shown in broken lines.

In order to permit correct application of the sole to the ski the front part of the sole has at 31 a depression, the depth of which corresponds to the thickness of the plate 1.

In the embodiment illustrated the plastic front part 31 of the sole covers the entire boot and thus contributes to the progressive flexibility of the sole as it extends from the front to the back of the boot.

It will of course be appreciated that the embodiments which have been described have been given purely by way of illustration and example and may be modified as to detail without thereby departing from the basic principles of the invention as defined by the following claims.

What is claimed is:

1. A cross-country ski binding and ski shoe assembly comprising:

a ski shoe including a flexible sole with a relatively rigid integral extension of said sole protruding at the front of the shoe and projecting beyond the toe of the shoe, said rigid extension being flexibly connected to the sole by a thinner section, and surface means on said rigid extension for engaging a binding and for securing the shoe to the binding, a ski binding including an archplate having two upwardly extending lateral walls and a horizontally extending upper part, and latch means engaging said extension of the sole to retain said extension in the archplate, said extension having a vertical cross-section corresponding in width and height to the space delimited beneath the upper part of said archplate between said lateral walls.

2. A binding and shoe assembly as claimed in claim 1 in which the archplate is parallelopipedic in form.

3. A binding and shoe assembly as claimed in claim 1 in which the upper part of the archplate consists of a wall which is continuous over its entire length.

4. A binding and shoe assembly as claimed in claim 1 in which the upper part of the archplate consists of two arms at the top of the plate which are bent at right angles toward each other.

5. A binding and shoe assembly as claimed in claim 1 in which the archplate carries two divergent arms lying in vertical planes which serve to guide the right and left sides of the front of the shoe.

6. A binding and shoe assembly as claimed in claim 1 in which the latch means is a rod fixed to the archplate and adapted to vertically engage in a hole in the extension of the sole.

7. A binding and shoe assembly as claimed in claim 1 in which the latch means is a horizontal pin which passes through the lateral walls of the archplate and through a hole in the extension of the sole extending the width of the extension of the sole.

8. A binding and shoe assembly as claimed in claim 7 in which the hole in the extension of the sole which receives the latch means is lined with a sleeve of metal or plastic material.

9. A binding and ski shoe assembly as claimed in claim 1 in which the archplate is integral with a base plate secured to the ski.

10. A binding and ski shoe assembly as claimed in claim 9 in which the base plate is embedded in the ski.

11. A binding and ski shoe assembly as claimed in claim 9 in which the base plate is embedded in the ski beneath a lamination which constitutes the upper surface of the ski.

12. A binding and ski shoe assembly as claimed in claim 1 in which the ski has a shaped protuberance in front of the archplate.

13. An assembly as claimed in claim 1 wherein the width of said archplate and the width of said extension correspond essentially to the width of the ski.

14. A cross-country ski binding and ski shoe assembly comprising:

a ski shoe including a flexible sole with a relatively rigid integral extension of said sole protruding at the front of the shoe, said rigid extension being flexibly connected to the sole by a thinner section, and surface means on said rigid extension for engaging a binding and surface means on said extension for securing the shoe to the binding.

15. A ski binding and ski shoe assembly as claimed in claim 14 in which the sole and its extension are molded directly from a plastic material.

16. A binding and ski shoe assembly as claimed in claim 15 in which the lower front part of the sole and its extension define a recess the depth of which corresponds to the thickness of a base plate which supports the archplate.

17. A ski-binding and ski-boot assembly comprising:

a ski-boot including a sole and an integral extension of said sole having the rigidity of said sole and protruding at the front of the boot, a ski-binding including an archplate having two vertically extending lateral walls and a horizontally extending upper part, latch means which enters a recess in said extension of the sole to retain said extension in the archplate, wherein said extension has a rectangular vertical cross-section and a volume corresponding in width and height to the space delimited beneath the upper part of said archplate between said lateral walls, in which the sole and its extension are molded directly from a plastic material, and in which the extension of the boot which fits into the archplate is connected to the sole proper by a thinner zone assuring a flexibility which facilitates lifting of the heel.

18. A ski binding and ski boot assembly comprising:

a ski boot including a flexible sole and an integral rigid extension of said sole protruding at the front of the boot, a ski binding including an archplate having two vertically extending lateral walls and a horizontally extending upper part connecting the two walls, and latch means which extends through said archplate and which enters a recess in said extension of the sole to retain said extension in the archplate, said extension having a vertical cross-section corresponding in width and height to the space delimited beneath the upper part of said archplate between said lateral walls.

* * * * *